United States Patent [19]

Phares

[11] Patent Number: 4,470,468

[45] Date of Patent: Sep. 11, 1984

[54] OFFSHORE DRILLING OF LARGE DIAMETER HOLES IN ROCK FORMATIONS

[75] Inventor: Lindsey J. Phares, Sugar Land, Tex.

[73] Assignee: Raymond International Builders, Inc., Houston, Tex.

[21] Appl. No.: 511,504

[22] Filed: Jul. 6, 1983

Related U.S. Application Data

[62] Division of Ser. No. 259,046, Apr. 30, 1981, Pat. No. 4,415,045.

[51] Int. Cl.[3] ..... E21B 43/01

[52] U.S. Cl. ..... 175/7

[58] Field of Search ..... 175/5–10, 175/220; 405/227, 228; 308/4 A

[56] References Cited

U.S. PATENT DOCUMENTS

| | | | |
|---|---|---|---|
| 427,149 | 5/1980 | Brown | 405/10 |
| 712,002 | 10/1902 | Packard | 175/9 |
| 946,841 | 1/1910 | Gilman | 405/11 |
| 1,421,857 | 7/1922 | Store | 405/222 |
| 2,354,142 | 7/1944 | Quinn | 405/223 |
| 3,101,798 | 8/1963 | Wilson et al. | 175/8 |
| 3,114,420 | 12/1963 | Wilde | 175/7 X |
| 3,248,886 | 5/1963 | Blenkarn | 175/7 X |
| 3,252,529 | 5/1966 | Fischer | 175/7 |
| 3,282,356 | 11/1966 | Paulson et al. | 175/220 |
| 3,486,555 | 12/1969 | Vincent | 175/7 X |
| 3,633,685 | 1/1972 | Piexoto | 175/6 |
| 3,672,177 | 6/1972 | Manning | 175/7 X |
| 3,672,447 | 6/1972 | Kofahl | 175/7 X |
| 3,955,372 | 5/1976 | Pogonowski et al. | 405/225 |
| 3,996,755 | 12/1976 | Kalinowski | 175/7 X |
| 4,109,477 | 8/1978 | Vogel | 61/87 |
| 4,220,421 | 9/1980 | Thorne | 166/368 |
| 4,227,831 | 10/1980 | Evans | 175/7 X |
| 4,269,544 | 5/1981 | Rusche | 405/233 |
| 4,323,118 | 4/1982 | Bergmann | 166/368 |

FOREIGN PATENT DOCUMENTS

| | | | |
|---|---|---|---|
| 866664 | 4/1961 | United Kingdom | 61/46 |
| 2039575 | 8/1980 | United Kingdom | 175/7 |

OTHER PUBLICATIONS

*Floating Rigs Build Piers* by H. K. Glidden, Roads & Streets, Feb. 1965.

*Wirth Airlift Drilling Rigs, Pile Boring Equipment*, Published by Maschinen Und Bohrgerate Fabrik, Alfred Wirth & Co. K.G., 514 Erkelenz/Fed. Republic of Germany, P.O. Box 1327/1329.

*Review of Reverse Circulation Air Lift Methods for Big Hole Drilling* by J. H. Allen, SME Transactions, Jun. 1977 pp. 86–93.

*Drilling Large Diameter Holes* by J. H. Allen, Australasian Oil & Gas Review, Reprinted by Smith Tool Co. Division of Smith International Inc., Compton, Calif.

*Primary Examiner*—Ernest R. Purser

*Assistant Examiner*—Thuy M. Bui

*Attorney, Agent, or Firm*—Fitzpatrick, Cella, Harper & Scinto

[57] ABSTRACT

A drilling rig comprises a platform (10) supported above a sea surface (14) by legs which extends to the sea bottom (16). A drill guide (30) of rigid open framework construction extends down from the platform to the sea bottom. The drill guide is only minimally affected by turbulent sea conditions because of its open framework construction. A hardenable substance such as concrete (54) is poured into a flexible bag (50) at the lower end of the drill guide to form a solid structure conforming to the uneven sea bottom and having a substantially flat upper surface. Drilling takes place through the hardenable substance and into the underlying sea bottom.

5 Claims, 10 Drawing Figures

12
24
26
18
20
28
42
10
22
14
34
30
36
38
40
32
16

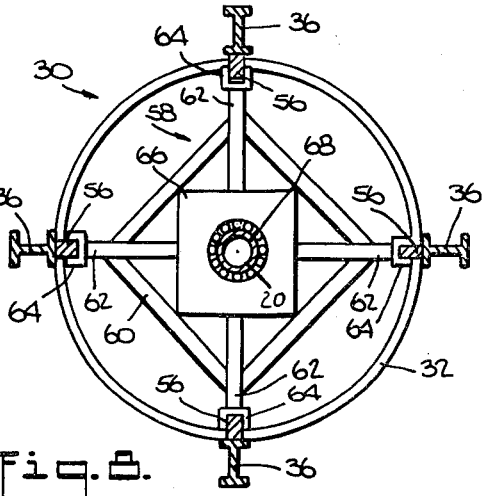
Fig. 8.
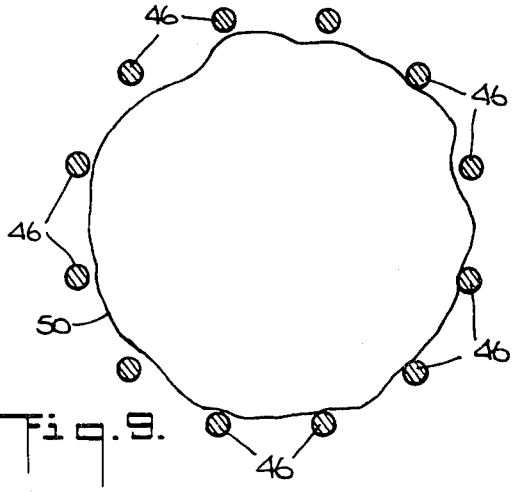
Fig. 9.
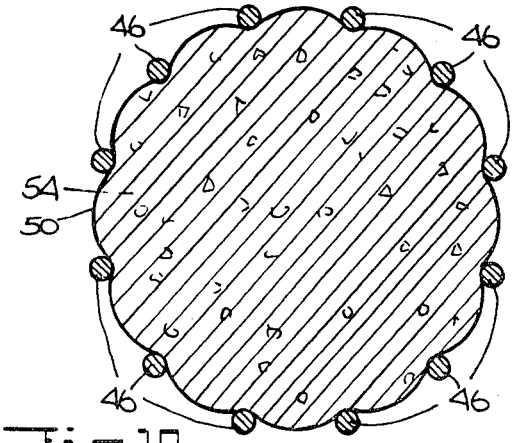
Fig. 10.
Fig. 3.
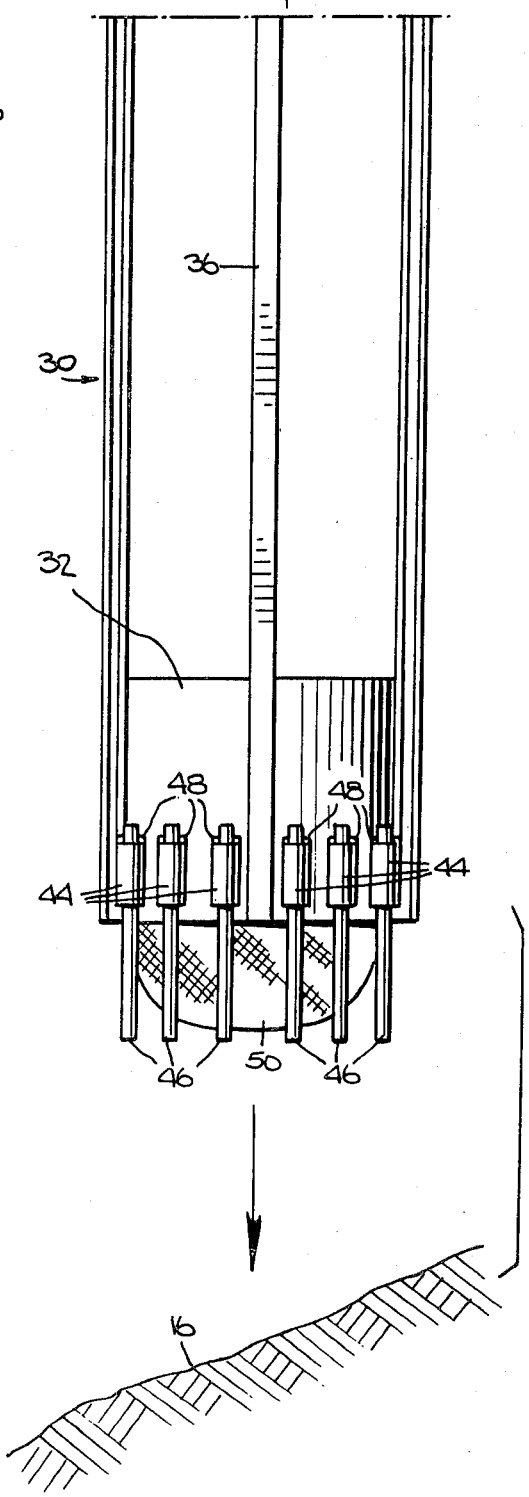

OFFSHORE DRILLING OF LARGE DIAMETER HOLES IN ROCK FORMATIONS

This is a division of application Ser. No. 259,046, filed Apr. 30, 1981. Now U.S. Pat. No. 4,415,045.

This application also discloses subject matter disclosed in application Ser. No. 511,539 filed July 6, 1983, which also is a division of application Ser. No. 259,046 filed Apr. 30, 1981 now U.S. Pat. No. 4,415,045.

BACKGROUND OF THE INVENTION

1. Field of the Invention

This invention relates to rock drilling and more particularly it concerns the formation of large diameter holes in rock outcroppings on a sea bed.

2. Description of the Prior Art

The drilling of large diameter holes in the sea floor is known. The prior art includes the provision of a jack-up platform having legs which extend down to the sea floor and support the platform above the sea surface. A large diameter tubular drill guide is attached at its upper end to the platform and extends down to the sea floor. A drill or cutter assembly and a drill string or drill pipe is inserted into the guide at the platform and is lowered down through the guide to the sea floor. A drive mechanism on the platform turns the upper end of the drill string or drill pipe to rotate the cutter assembly which bores into the earth or rock to form a hole. Stabilizer assemblies are arranged along the drill string or drill pipe and these serve to center the drill string as it rotates and moves down inside the guide. This prior art is shown in a publication entitled *Wirth Airlift Drilling Rigs, Pile Boring Equipment* and published by Maschinen Und Bohrgerate-Fabrik, Alfred Wirth & Co. K.G. 514 Erkelenz/Fed. Republic of Germany P.O. Box 1327/1329. Other publications of interest in the prior art are *Review of Reverse Circulation Air Lift Methods for Big Hole Drilling* by J. H. Allen, SME Transactions, June 1977 pp. 86–93, *Drilling Large Diameter Holes* by J. H. Allen from Australasian Oil & Gas Review and reprinted by Smith Tool Co. division of Smith International Inc., Compton California and *Floating Rigs Build Piers* by H. K. Glidden, published in Roads and Streets, February 1965.

A problem arises when the above described arrangement is used for drilling large diameter holes in areas where the sea is especially turbulent. This is because the large waves and currents produced by turbulent seas impose a great load on the large diameter drill guide and may cause it to bend or fracture or break away from its attachments to the drilling mechanism.

Another problem that arises when drilling large diameter holes in rock outcroppings in the sea bed is due to the fact that the sea bed in such locations is usually rough and sloping. As a result, the drill is likely to be thrown laterally off position when it initially encounters the rock at the sea bed. In addition, the sudden shock produced by engagement of only part of the drill with any projection of the rocky sea bottom could cause stresses that would be harmful to the drill or the drilling mechanism.

The prior art shows various arrangements for positioning drill bits at a sea bed. U.S. Pat. Nos. 3,114,420, 3,252,529, 3,486,555 and 3,672,447 all show means including cables or relatively flexible pipes for guiding a drill down to a drilling location. These arrangements, however, are all associated with a floating vessel. Moreover, they would not be suitable for drilling into a rock outcropping because they rely on forming a stabilized base in a relatively soft overburden on the sea bed. In addition, the holes proposed to be drilled with these prior arrangements are of small diameter and it is not important that the drill and drill string be maintained in precise alignment between the drilling mechanism and the hole being drilled. U.S. Pat. No. 3,248,886 shows a riser pipe for a floating rig but this riser pipe is not maintained in alignment; in fact, a flexible joint is provided along its length.

U.S. Pat. Nos. 2,354,142, 946,841, 427,149 and 3,672,177 all propose structures having moveable elements along their lower edge to conform to an uneven sea bottom but none of these patents relate to drilling operations and none of them provide any indication of how to avoid the problem of starting a drill bit smoothly and accurately in an uneven rock surface without damage to the drill bit.

The present invention, in one aspect, solves the abovedescribed problem of maintaining a drill and drill string in proper alignment for drilling large diameter holes in a rocky sea bottom where the sea is turbulent. According to this aspect of the invention there is provided a drilling rig with legs which rest on the sea floor and which support a platform up above the surface of the sea. A rigid open framework drill guide extends down from the platform to the sea bottom to guide the drill and drill string. The drill guide may comprise a plurality of vertically spaced apart short cylindrical sections held in place by vertical columns. Centering elements are provided to be guided vertically along rails in the drill guide; and these elements hold the drill string centered and in proper alignment with the drill. Cables may be provided at the lower end of the drill guide and these may run through sheaves in the adjacent supporting legs and up to the platform to winches which serve to maintain proper positioning of the lower end of the drill guide. Because of the open framework construction of the drill guide it provides minimal surface to the turbulent sea and accordingly waves and currents do not impose excessive stresses on the drill guide or its supports.

In another aspect of the invention the lower end of the drill guide is provided with a flexible container and vertically moveable reinforcing rods are distributed about the lower periphery of the drill guide outside the container. When the drill guide contacts the uneven sea bottom, the reinforcing rods extend by different amounts down to the uneven rock surface according to the elevation of the rock surface at their particular locations. A hardenable substance, such as concrete, is then introduced into the lower end of the drill guide to fill the flexible container and the fully or partially fill the lower end of the drill guide. The reinforcing rods serve to keep the concrete from flowing laterally under the drill guide and bursting the container. The concrete will conform itself at the bottom to the irregularities of the rock surface but it will be substantially flat at its upper surface. After the concrete hardens, a rock drill is lowered down through the drill guide to the hardened concrete. Drilling begins at the flat upper surface of the concrete and continues down through the concrete and into the underlying rock. With this arrangement the drill is not subjected to lateral skipping or undue stresses due to localized contact with the sea bed. Also the concrete provides a gradual transition for the drill into the hard rock material of the sea bed.

The invention may be carried out in various ways and is not limited to the specific way described below which is the best mode contemplated by the inventor.

DESCRIPTION OF THE DRAWINGS

FIG. 3 is an enlarged side elevational view of the lower end of a drill guide used in the offshore tower rig of FIG. 1;

FIG. 8 is a cross section view taken along line 8—8 of FIG. 7;

FIG. 9 is a cross section view taken along line 9—9 of FIG. 4; and

FIG. 10 is a cross section view taken along line 10—10 of FIG. 5.

DETAILED DESCRIPTION OF THE PREFERRED EMBODIMENT

Figure 1:
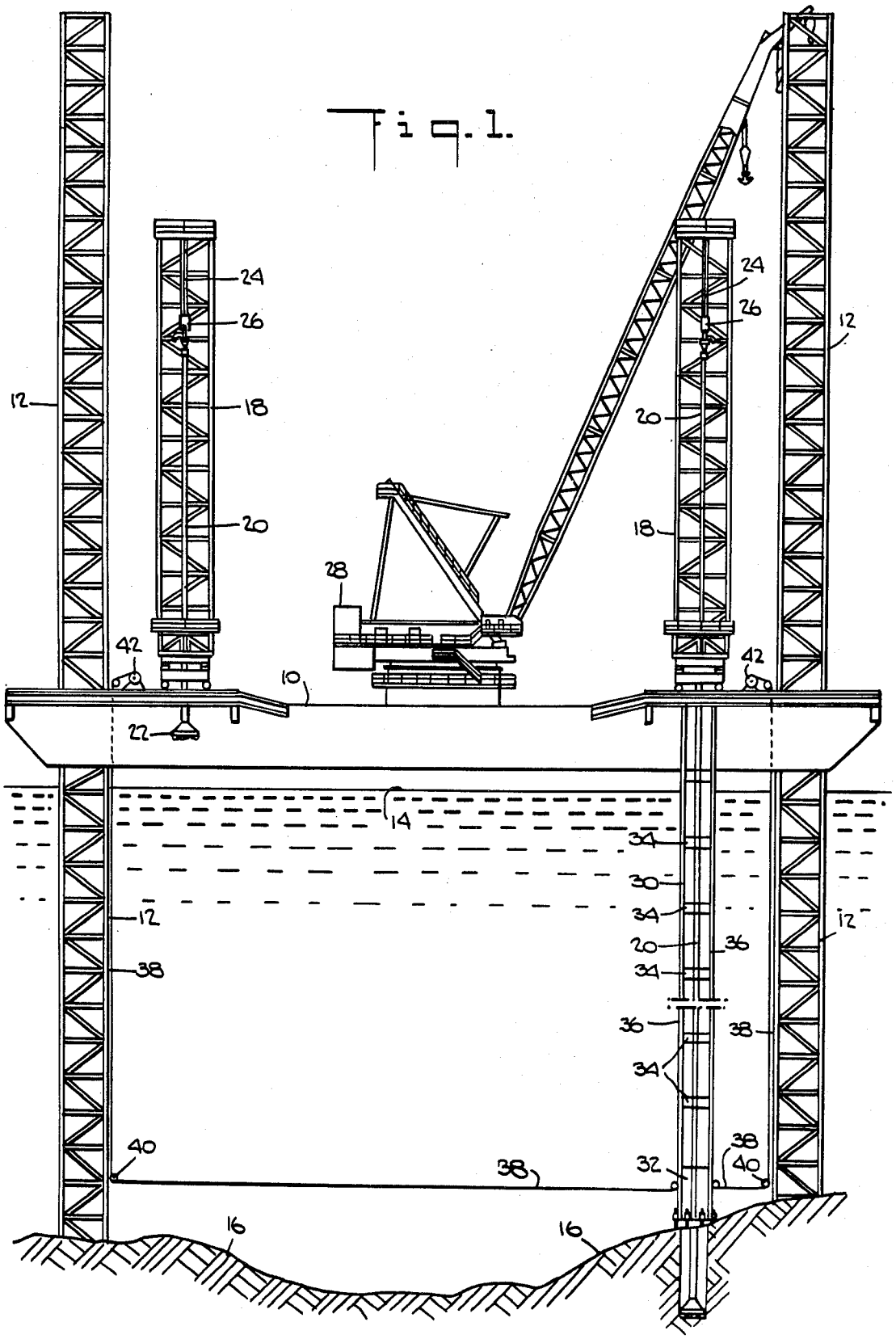
FIG. 1 is a side elevational view of an offshore drilling rig in which the present invention may be embodied.
Figure 2:
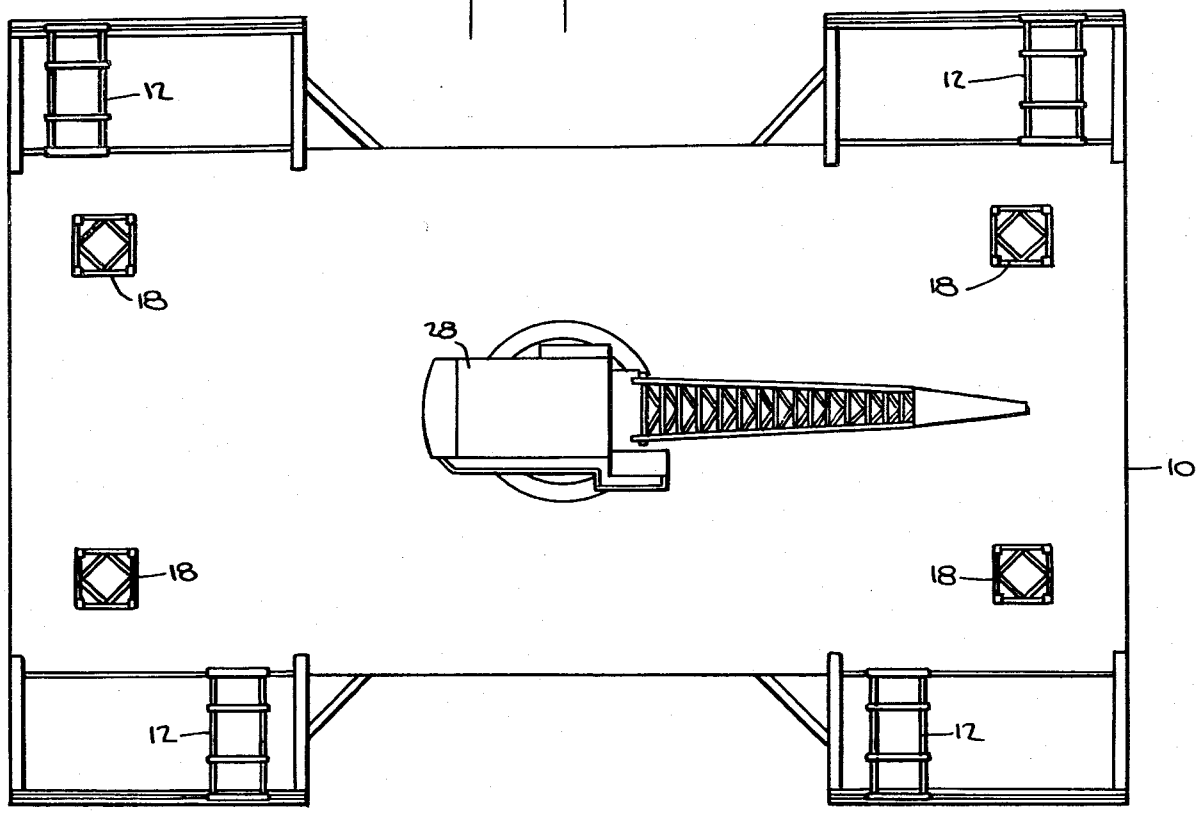
FIG. 2 is a top plan view of the offshore drilling rig of FIG. 1.

The offshore drilling rig shown in FIGS. 1 and 2 may comprise a horizontal platform 10 supported by framework legs 12 above a sea surface 14. The lower ends of the legs 12 rest on a sea bottom 16 where drilling is to take place. As pointed out above, this invention would be particularly suited to drilling of large diameter holes, e.g. four to ten feet (1.2–3.0 meters) or more, into rock outcroppings in the sea bottom. Accordingly, in FIG. 1 the sea bottom 16 is a rock outcropping of uneven or irregular slope.

The drilling rig of FIGS. 1 and 2 may be self contained; and in such case the platform 10 may take the form of a flotatable hull. Also, the legs 13 may be arranged to pass through the platform 10 and be interconnected to the hull through suitable jack-up means (not shown, but well known in the art) to lift the platform up above the surface of the water so that it is isolated from waves and currents and is maintained stably in a fixed position over the drilling site.

Drilling towers 18 of known construction are provided on the platform 10 and these drilling towers support a drill string 20 having a rock drill 22 at is lower end. As shown in general outline, a lowering device 24 and a rotary driver 26 are provided in each tower 18 to lower and rotate such drill and drill string. These devices are well known in the art of drilling and do not per se constitute the novel feature of the invention. Accordingly, in the interest of clarity they are not described in detail herein. The constructions of the drill string 20 and the rock drill 22 are also well known per se and are not described in detail here except to say that the rock drill may have a diameter of four to 10 feet (1.2–3.0 meters) or more; and the drill string 20 should be of suitable diameter to drive the rock drill.

Conventional reverse circulation means (not shown) are also provided to introduce air down through an air passage in the drill string to a location slightly above the drill bit so that cuttings produced by the rock drill will, by virtue of the well known air lift principle, be carried from the hole being drilled and up through the center of the drill string and discharged at the elevation of the platform 10. A derrick 28 is also provided on the platform 10 to service the towers 18 and to add additional lengths to the drill string 20.

Figure 7:
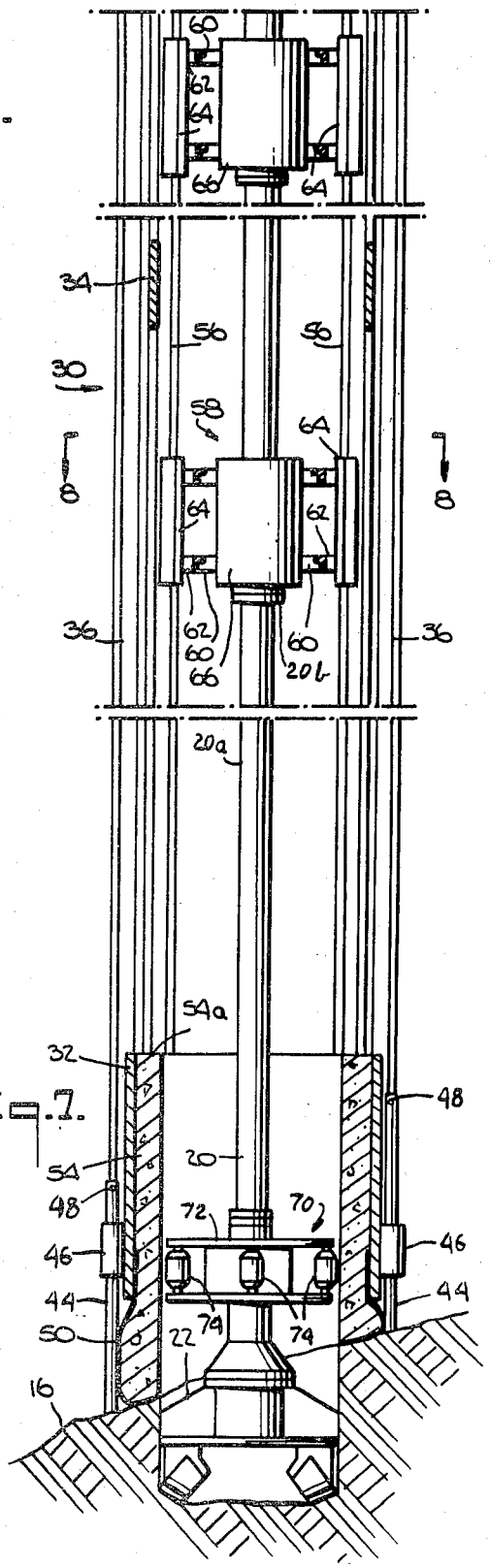
FIG. 7 is a view similar to FIG. 6 bit showing the drill bit drilling past the levelling layer and into underlying rock.

As can be seen in FIG. 1, a drill guide 30 extends down from the platform 10 to the sea bottom 16. The drill guide 30 is of rigid open framework construction. As shown in FIGS. 1, 7 and 8, the drill guide 30 comprises a plurality of spaced-apart short cylindrical sections 32 and 34 and a plurality of vertically extending elongated H-beam columns 36. The columns 36 extend from the sea bottom 16 up to the platform 10 and the cylindrical sections 32 and 34 are welded to the columns at various elevations above the sea bottom 16. The upper end of the drill guide is secured, as by welding, to the platform 10. In order to ensure that the lower end of the drill guide 30 is properly located on the sea bottom, it is provided with a plurality of positioning cables 38 (FIG. 1) which are attached to and extend from lower end of the drill guide to sheaves 40 at the lower ends of the legs 12. The cables 38 pass through the sheaves 40 and extend up along the legs 12 to winches 42 on the platform deck. By operating different winches to pull on selected cables the lower end of the drill guide can be kept in proper alignment with its upper end.

In normal operation, the platform 1 is floated to a desired location with the legs 12 and the drill guide 30 in raised condition. When the platform reaches the desired drilling location, the legs 12 are lowered to the sea bottom 16 and then the platform 10 is jacked up out of the water as shown in FIG. 1. Thereafter, the drill guide 30, with the positioning cables 38 attached, is lowered through the platform until it reaches the sea bottom 16. At that point the upper end of the drill guide is secured to the platform. During the lowering of the drill guide 30 the winches 42 are operated selectively to maintain vertical alignment of the lower end of the drill guide.

Figure 4:
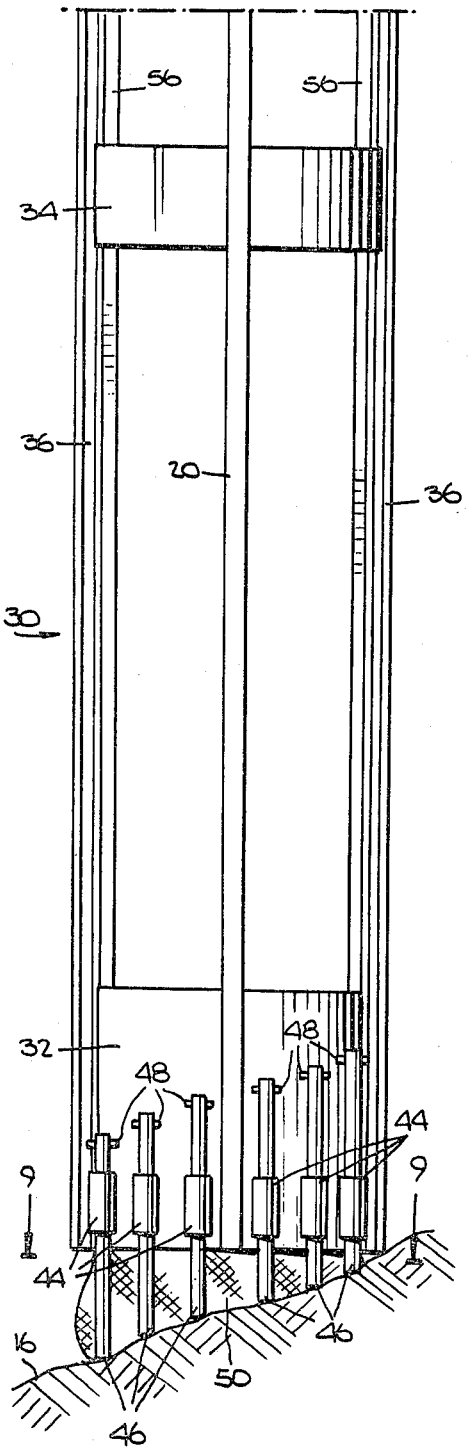
FIG. 4 is a further view similar to FIG. 3 showing the drill guide against an irregular rock surface of a sea bed.

FIGS. 3 and 4 illustrate one of the novel features of the drill guide 30. As can be seen, the lowermost cylindrical section 32 has welded to its outer surface a plurality of vertically extending short tubular sleeves 44. Each sleeve has a reinforcing rod 46 loosely fitted therein for free up and down movement in the sleeve. A cross bar or stop 48 is provided at the upper end of each of the rods 46 to engage the upper end of the sleeve 44 and prevent the rod from falling through the sleeve. As can be seen in FIG. 3, the rods 46 are of sufficient length so that as the drill guide 30 is lowered the rods extend down past the lower end of the lowermost cylindrical section 32.

There is also provided at the lower end of the cylindrical section 32 a cup-shaped flexible container 50. The container 50 which may be a plastic or nylon fabric bag, is of the same diameter as the cylindrical section 32 and its peripheral edge is secured to the lower rim of the cylindrical section by suitable means such as an adhesive or hooks (not shown) formed just inside the cylindrical section.

When the drill guide 30 is lowered to the sea bottom 16, as shown in FIG. 4, the uneven sea bottom will cause different ones of the rods 46 to be pushed up different amounts into their respective sleeves 44 so that they will effectively follow or conform to the contour of the sea bottom. The flexible container 50 also extends down from the lower edge of the drill guide and lies along the sea bottom 16 inside the reinforcing rods 46.

Figure 5:
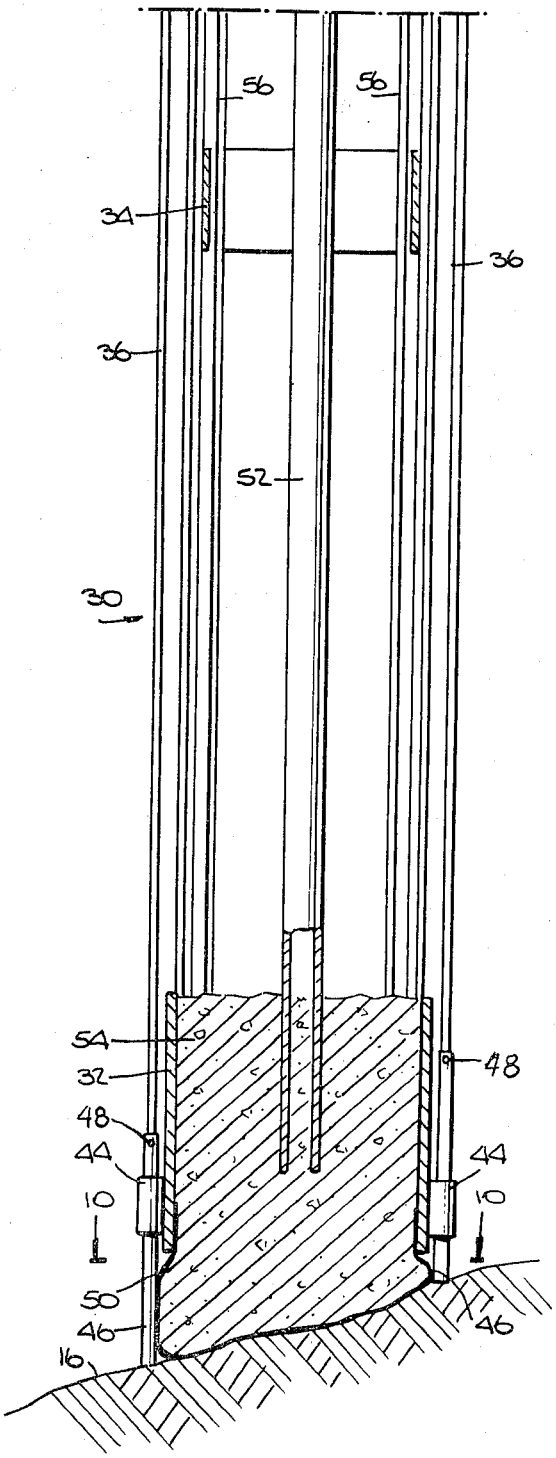
FIG. 5 is an elevational section view of the drill guide of FIG. 4 and showing the placement of a leveling layer therein.

At this point a concrete supply tube 52 is inserted down through the drill guide 30, as shown in FIG. 5, and concrete 54 is poured down into the lowermost cylindrical section 32. As can be seen, the concrete 54 flows down through the bottom of the cylindrical section 32 and into the flexible container 50. The flexible container expands laterally due to the pressure of the heavy concrete; but, as can be seen in FIGS. 9 and 10, the expansion of the container 50 is limited by the reinforcing rods 46. It can also be seen that the poured concrete is effectively contained below the lower cylindrical section 32 even though it is resting on an uneven rock surface. Farther, because of its fluidity and weight, the poured concrete will conform to the uneven rock surface contour. As pouring of the concrete 54 continues, it either partially or fully fills the interior of the lower cylindrical section 32; and because of its fluid nature before setting, the concrete will assume a substantially flat upper surface 54*a* inside the lower cylindrical section, as shown in FIG. 7.

After the concrete 50 has hardened, the rock drill 22 is lowered, by means of the drill string 20, down through the drill guide 30 to the upper surface 54*a* of the concrete inside the lower cylindrical section 32. The rock drill 22 is then made to drill through the hardened concrete 54 and down past it into the underlying rock forming the sea bottom 16, as shown in FIG. 7.

Figure 6:
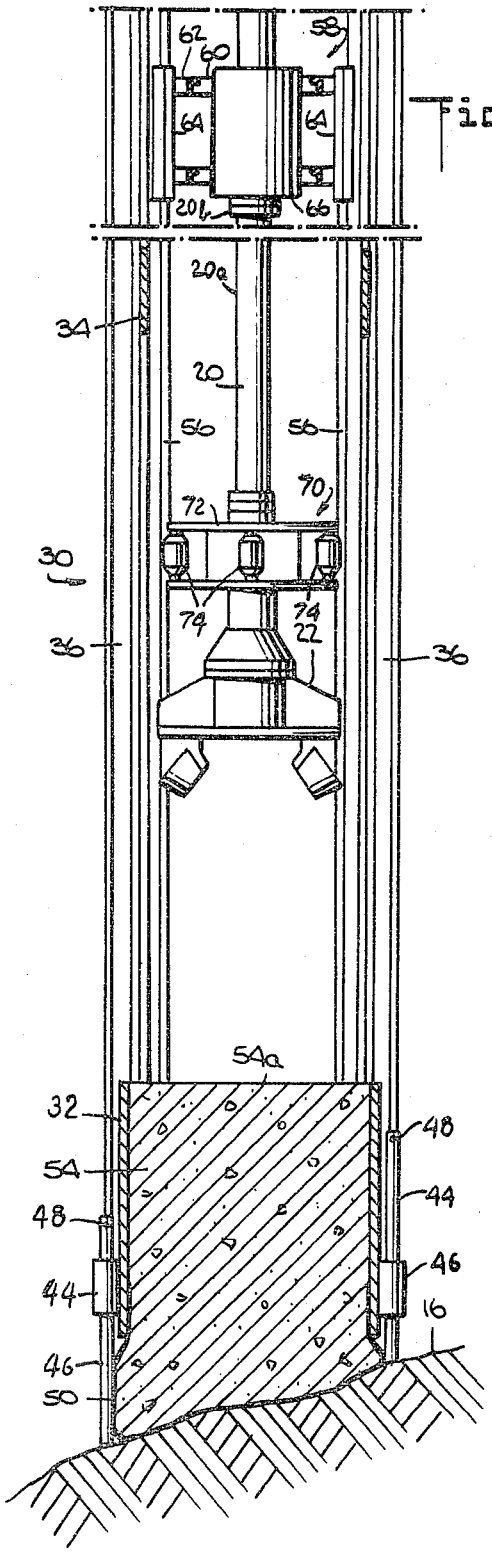
FIG. 6 is a view similar to FIG. 5 but showing the lowering of a drill bit onto the leveling layer.

As shown in FIG. 6, a further centering element 70 is also provided at the lower end of the drill string 20 just above the drill bit 22. This further centering element comprises a frame 72 on the drill string and a plurality of vertical rollers 74 distributed about the periphery of the frame 72. The rollers 74 are positioned such that the overall diameter of the further centering element 70 is slightly less than the outer diameter of the drill bit 22. As can be seen in FIG. 7, the further centering element 70 follows the drill bit 20 down into the hole being drilled and is guided by the hole to help maintan the lateral positioning of the drill bit.

It will be seen that the hardened concrete 54 inside the lower cylindrical section 32 of the drill guide provides a substantially flat surface for the drill 22 to begin its drilling operation. Also, the concrete is not so hard or resistive to drilling as the underlying rock. Accordingly, the drill 22 moves smoothly and accurately down to the sea bottom 16; and in doing so it forms in the concrete 54, a guide to hold the drill against lateral deflections which might otherwise occur when it encounters the underlying rock in the sea bed 16. Also the relatively hard composition of the concrete 54 provides a relatively smooth transition into the underlying rock so that stresses on the drill 22 and its driving mechanism are minimized.

After the drilling operation is completed the drill 22 is raised and withdrawn from the drill guide 30. The drill guide may then be removed; and in so doing the remaining concrete inside the drill guide 30 will break off at the bottom of the drill guide. After the drill guide is raised, the concrete remaining inside the drill guide may readily be broken away. If desired, a diver may first remove the pins 48 after the concrete is set but before the drill guide is raised so that when it is raised the reinforcing rods may be left behind. This will avoid possible interference in removal of the drill guide.

The purpose of the drill guide 30 is to hold the drill 22 and drill string 20 in precise vertical alignment during the drilling operation. It is important, when drilling large diameter holes into a rock formation, to hold the drill and drill string in precise vertical alignment in order to minimize stresses on the drill and the drilling mechanism. In order to maintain this precise vertical alignment it is necessary to provide a rigid drill guide with special centering elements to hold the drill string at various elevations. As mentioned above, the prior art provided rigid large diameter drill guides made of large diameter cylinders down through which the drill, drill string and centering elements travelled. These large diameter cylindrical guides are considered unsuitable for environments with large waves and water currents because the reaction forces which these waves and currents impose on a large diameter cylinder may cause the drill guide to fracture or bend.

Another novel feature of this invention lies in the particular construction of the drill guide 30. As can be seen, the cylindrical sections 32 and 34 of the drill guide 30 occupy only a very minor portion of the overall height of the drill guide; and the elongated columns 36 are spaced apart from each other around the cylindrical sections so that the drill guide is of open yet rigid construction. Because of this open construction very little surface area is presented to waves and currents and accordingly the stresses produced by these waves and currrents on the drill guide and its attachment to the platform 10 are minimized.

As can be seen in FIGS. 7 and 8, there are provided four vertical H-beam columns 36 distributed equidistantly around the outside of and welded to the cylindrical sections 32 and 34. The diameter of the cylindrical sections is somewhat larger than the diameter of the hole to be drilled so as to permit the rock drill 22 to pass through. There are also provided guide rails 56 inside the cylindrical sections and extending up and down along the column 36. These guide rails serve to locate and provide vertical guidance for spiderlike centering elements 58 which maintain the drill string 20 centered in the drill guide 30. As can be seen, the centering elements 58 each comprise a framework structure 60 having four radial extensions 62 on the ends of which are provided guide shoes 64 which fit over and slide along the guide rails 56. In the middle of the framework structure 60 is a guide 66 with an opening 68 through which the drill string 20 passes. The drill string itself, as shown in FIGS. 6 and 7, is made up of individual lengths of pipe 20*a* which are connected together by flanges 20*b*. These flanges also support the centering elements 58 so that they remain vertically spaced apart from each other during the drilling operation. In this manner the drill string is properly supported along its length and is maintained properly centered and aligned for drilling. At the same time the construction and arrangement of the centering elements 58 also provides minimal cross sectioned areas to minimize any reaction to the effects of waves and water currents.

The present invention is considered to be especially suitable for use in regions when the water depth is one hundred to two hundred feet (30.48–60.96 meters) and where storms cause high waves and water currents. The drilling operations according to the present invention should provide the capability to drill holes in rock outcroppings on the sea bottom where such holes may have a diameter of four to ten feet (1.22–3.48 meters) and a depth of twenty to sixty feet (6.09–18.29 meters).

In a typical embodiment of the invention the lower cylindrical section 32 of the drill guide 30 would have a length of about fifteen feet (4.57 meters) while the other cylindrical sections 30 would have a length of about three feet (0.91 meters). The diameter of the cylindrical sections would be somewhat greater than the diameter of the drill 22 to permit it to be lowered down to the sea bottom. The vertical spacing between successive cylindrical sections would be about fifteen feet (4.57 meters). The sleeves 44 would have a diameter of about five inches (12.7 cm) and a length of about two feet (61 cm). The lower end of each sleeve would be about six inches (15.2 cm) up from the bottom edge of the lower cylindrical section 28. The reinforcing rods 46 would have a diameter of about four inches (10.16 cm) and a length of about six feet (1.83 meters).

The drill string 20 has an outer diameter of about twelve inches (30.48 cm) and it may be of double walled pipe with suitable arrangements, not shown but well known in the prior art, for supplying compressed air to the region of the rock drill 22 so that rock cuttings formed by the drill will be carried up through the drill string to the surface.

The foregoing dimensions are given only by way of example and it will readily be appreciated by those skilled in the art, after reaching the description herein, than other dimensions and other structural modifications can be made within the scope of this invention.

I claim:

1. Apparatus for drilling large diameter vertical holes in rock outcroppings on a sea bed, said apparatus comprising a drilling structure including legs extending up from the sea bed to a location above the surface of the sea, a platform supported by said legs above the sea surface, a drilling mechanism on the platform, said drilling mechanism including a rotary rock drill cutter assembly, a drill string extending up from the rock drill cutter assembly, a rotary driver on the platform to rotate the drill string and a lowering device on the platform to lower the drill string, and a drill guide secured at its upper end to said platform and having its lower end resting on the sea bed, said drill guide comprising a plurality of spaced apart vertical guide rails and a plurality of vertically spaced apart supporting sections, each supporting section interconnecting each of said guide rails and maintaining same in a rigid open framework configuration with minimal surface area to minimize stresses produced by waves and current and drill string centering elements arranged to move up and down along said guide rails to hold said drill string centered therebetween, whereby said drill string and cutter assembly are maintained in proper orientation for beginning a drilling operation and said frame assembly provides substantial rigidity with minimal resistance to waves and currents from the sea.

2. Apparatus according to claim 1 wherein said vertically spaced apart elements are cylindrical sections.

3. Apparatus according to claim 2, wherein said guide rails are mounted on vertically extending H-beams welded to said cylindrical sections.

4. Apparatus according to claim 1 wherein centering cables are connected to the lower end of the drill guide and extend from said drill guide to different ones of said legs and up along said legs to said platform.

5. Apparatus according to claim 4 wherein said centering cables pass through sheaves near the lower ends of said legs and from there to associated winches on said platform.

* * * * *

UNITED STATES PATENT AND TRADEMARK OFFICE

CERTIFICATE OF CORRECTION

PATENT NO. : 4,470,468

DATED : September 11, 1984

INVENTOR(S) : Lindsey J. Phares

It is certified that error appears in the above-identified patent and that said Letters Patent is hereby corrected as shown below:

Column 2, line 54, change "the" (second occurrence) to -- to --.

Signed and Sealed this

Ninth Day of April 1985

[SEAL]

*Attest:*

DONALD J. QUIGG

*Attesting Officer* *Acting Commissioner of Patents and Trademarks*